US008090305B2

(12) United States Patent
Iseki et al.

(10) Patent No.: US 8,090,305 B2
(45) Date of Patent: Jan. 3, 2012

(54) FIXING UNIT AND IMAGE FORMING APPARATUS

(75) Inventors: Toshiyuki Iseki, Kanagawa (JP); Hisayoshi Ohshima, Kanagawa (JP); Takahiko Matsumoto, Kanagawa (JP); Yukimichi Someya, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 93 days.

(21) Appl. No.: 12/770,145

(22) Filed: Apr. 29, 2010

(65) Prior Publication Data

US 2010/0284716 A1 Nov. 11, 2010

(30) Foreign Application Priority Data

May 11, 2009 (JP) ..... 2009-114659
Jan. 20, 2010 (JP) ..... 2010-009689

(51) Int. Cl.
*G03G 15/20* (2006.01)

(52) U.S. Cl. ..... 399/340

(58) Field of Classification Search ..... 399/107, 399/122, 320, 328, 340; 430/124.1, 124.21, 430/124.22

See application file for complete search history.

(56) References Cited

U.S. PATENT DOCUMENTS 7,599,653 B2 * 10/2009 Asakura et al. ..... 399/340
7,655,374 B2 * 2/2010 Katano et al. ..... 430/124.1
7,773,932 B2 * 8/2010 Katano et al. ..... 399/340
7,813,689 B2 * 10/2010 Nakamura et al. ..... 399/340

FOREIGN PATENT DOCUMENTS

JP 2006-78573 3/2006
JP 2007-219105 8/2007
JP 2008-197188 8/2008
JP 2009-8967 1/2009

* cited by examiner

*Primary Examiner* — Hoan Tran
(74) *Attorney, Agent, or Firm* — Oblon, Spivak, McClelland, Maier & Neustadt, L.L.P.

(57) ABSTRACT

Disclosed is a fixing device including a liquid supply unit that supplies a liquid fixer containing a softening agent that dissolves or swells at least part of resin to soften the resin; an air supply unit that supplies air for foaming the liquid fixer; and a foam generation unit that mixes the liquid fixer from the liquid supply unit with the air from the air supply unit to generate foams. The foam generation unit has an air channel where the air from the air supply unit flows, a liquid-fixer channel provided such that the liquid fixer from the liquid supply unit flows from a direction opposite to a flowing direction of the air channel, and an air-and-liquid mixing part that mixes the air from the air channel with the liquid fixer from the liquid fixer channel so as to be opposite to each other, thereby generating a foam-like fixer.

5 Claims, 9 Drawing Sheets

FIXING UNIT AND IMAGE FORMING APPARATUS

BACKGROUND OF THE INVENTION

1. Field of the Invention

The present invention relates to fixing devices and image forming apparatuses, and specifically to a fixing device using a foam-like fixer that fixes resin-containing particles to a recording medium.

2. Description of the Related Art

Image forming apparatuses such as printers, facsimile machines, and copiers form images including characters and symbols based on image information on recording media such as papers, fabrics, and OHP sheets. Particularly, electrophotographic image forming apparatuses have been widely used in offices because they can form a high-definition image on plain paper at high speed. Such electrophotographic image forming apparatuses generally employ a thermal fixing method that includes heating and melting toner on a recording medium and applying a pressure to the melted toner so as to be fixed to the recording medium. Since this thermal fixing method can provide high fixing speed, high fixing-image quality, etc., this method is preferably used.

However, such electrophotographic image forming apparatuses consume about half or more of their total power when heating toner with the thermal heating method. On the other hand, low-power-consumption (energy saving) fixing devices are recently demanded from the viewpoint of environmental issues. In other words, it is desired to have a fixing method that extremely reduces a heating temperature to fix toner or one that does not require heating toner at all. Particularly, a nonthermal fixing method that does not require heating toner at all when fixing the toner to a recording medium is ideal from the viewpoint of low power consumption.

As the nonthermal fixing method, a wet fixing method is known. The wet fixing method uses an oil-in-water drop type fixing agent in which an organic compound that is capable of dissolving or swelling toner and insoluble or hardly soluble in water is dispersed and mixed with water. The wet fixing method includes spraying or dropping the oil-in-water drop type fixing agent onto unfixed toner placed at a predetermined position at the front surface of an object substance, dissolving and swelling the toner, and drying the object substance.

As an example of the wet fixing method, Patent Document 1 proposes a method for bringing a coating roller where a fixer is coated into contact with a recording medium on which unfixed toner has been placed. With this method, however, if the thickness of a fixer layer on the coating roller is thinner than that of an unfixed toner layer so as to coat the recording medium with a slight amount of the fixer, the unfixed toner is attracted by the surface tension due to the liquid film of the fixer at the front surface of the coating roller at the position where the coating roller is separated from the recording medium, which in turn causes the offset of toner particles to the front surface of the coating roller. As a result, an image on the recording medium is remarkably degraded.

Conversely, if the thickness of the fixer layer on the coating roller is substantially thicker than that of the unfixed toner layer, the surface tension due to the liquid film at the front surface of the coating roller hardly acts on the toner particles directly at the position where the coating roller is separated from the recording medium (because the fixer is abundant), which in turn does not cause the offset of the toner particles to the front surface of the coating roller. However, since a large amount of the fixer is coated on the sheet, the toner particles are flowed due to the excessive fixer. As a result, image quality is degraded and a long drying time is required, which causes a problem in fixing response. In addition, a significant residual liquid feeling (wet feeling obtained when an operator touches the sheet with his/her hand) occurs in the sheet. Moreover, when the fixer contains water, or when a large amount of the fixer is coated on a medium containing cellulose such as a sheet, the medium may significantly curl up, which possibly causes the jam of the sheet when the sheet is conveyed inside the image forming apparatus.

Accordingly, when the fixer is coated using a roller, it is really difficult to achieve both the slight coating of the fixer to the toner layer on the sheet so as to improve fixing response, reduce a residual liquid feeling, and prevent the curling of the sheet, and the prevention of toner offset to the fixing roller.

In order to address this problem, Patent Document 2 proposes a technique for performing the same process using a foam-like fixer to remarkably reduce the shift of toner to obtain an excellent image. This technique pays attention to the fact that the foam-like liquid containing a large amount of foam has an extremely low bulk density. Further, a thick fixer layer on a coating roller is required when coating is performed using a roller serving as a contact coating unit so as not to cause an offset to the roller. This means that the fixer at the front surface of the coating roller should have a certain level of volume when uniform coating is performed so as not to cause the offset of resin particles.

On the other hand, an amount of the fixer on the resin particle layer after coating is preferably small in terms of fixing response and residual liquid feeling. This means that the weight of the fixer is desirably low. In order to achieve both a large volume of the fixer at coating and a low weight of the fixer on a medium after coating, the density of the fixer should be low. Thus, the weight of the fixer to be coated can be substantially reduced even if the volume of the fixer is large at the coating. In other words, if the fixer having a low bulk density (value obtained by dividing the weight of the fixer by the volume thereof) is used, it is possible to achieve both the slight coating of the fixer and the prevention of toner offset to the fixing roller.

Further, Patent Document 3 proposes a method for generating small foams having a low bulk density. The method of Patent Document 3 includes a first foam generation step of blowing and stirring air in liquid and generating foam-like liquid having a foam diameter greater than a desired foam diameter. Further, the method also includes a second foam generation step of applying a shearing force to the foam-like liquid having the foam diameter greater than the desired foam diameter generated in the first foam generation step and generating the foam-like liquid having the desired foam diameter.

However, when the foam-like fixer is used as in Patent Documents 2 and 3, another problem arises. That is, when the foams generated by a foam generation unit are supplied under pressure to the coating roller through a tube, a large pressure is required due to the fluid resistance of the foams. The diameter of the foams is required to be smaller than the film thickness of the foams so that the foams are uniformly coated. However, the fluid resistance of the foams increases as the foam diameter becomes smaller. Further, a bulk density is required to be lowered so as to reduce the weight of the fixer on a medium. However, the foams having a low bulk density and a small foam diameter have extremely high fluid resistance. Therefore, a large pressure is required when the foams are supplied under pressure from the foam generation unit to the coating roller through the tube. As a result, a high-capacity pump is required for generating the large pressure.

The foams generated by the foam generation unit are repeatedly broken with time, and the diameter of the foams becomes gradually larger. When the foams, which have not been fixed for a certain period of time, are supplied under pressure from the foam generation unit to the coating roller through the tube, the foams cannot be used for fixing because they do not have desired properties. Therefore, the foams must be discharged and wasted outside a system. Further, when the foam-like fixer is coated on the entire surface of the coating roller, the foam-like fixer, which is coated on areas outside a recording medium where unfixed toner is placed (i.e., areas other than those corresponding to the width of the medium, parts between the mediums), is not used for fixing. The foams attached to the coating roller after fixing are required to be cleaned up. However, the volume of the foam-like fixer is extremely large (i.e., several tens of times as large as the liquid fixer), and thus the collected foams are required to be turned into liquid form immediately. If a large amount of the unnecessary foam-like fixer not used for the fixing exists, cleaning load extremely increases. To this end, a foam generation unit provided inside a film-thickness-controlling and coating unit generates the foam-like fixer, which in turn makes it possible to reduce a distance for supplying the foams under pressure. As a result, the fluid resistance required for supplying the foams under pressure can be reduced. Moreover, for example, if fixing is not performed for a long period of time to thereby change the properties of the foams, an amount of the foam-like fixer that must be discharged outside the system can be reduced. However, when the film-thickness-controlling and coating unit generates foams having a low bulk density and a small diameter, it requires a step of applying a shearing force to the foams and reducing the diameter of the foams in addition to the foam generation step of blowing air into the fixer. As a result, the configuration of the film-thickness-controlling and coating unit becomes complicated. Further, when the fixer is coated on the coating roller toward the width direction of a medium with the configuration of a slit having high fluid resistance and a manifold having low fluid resistance, some of the foams are broken. As a result, the diameter of the foams and the bulk density are increased.

In order to solve the above problems, it is required to arrange the foam generation unit having a small volume near the film-thickness-controlling and coating unit and coat the coating roller with foams immediately after the foams are generated. Thus, the distance for supplying the foams under pressure can be reduced. As a result, the fluid resistance required for supplying the foams under pressure can be reduced. Moreover, if fixing is not performed for a long period of time to thereby change the properties of the foams, an amount of the foam-like fixer that must be discharged outside the system can be reduced.

FIG. 1 shows the foam generation unit that generates foams having a small particle diameter. FIG. 1A is a perspective view of the foam generation unit, and FIG. 1B is a partially plan transparent view thereof. The foam generation unit 17 shown in FIG. 1A is generally called a micro mixer. In the micro mixer is arranged a primary channel part 17-1 composed of a liquid-fixer channel 17-1*a* which is shaped like a rectangular groove and in which a liquid fixer flows and an air channel 17-1*b* which is shaped like a rectangular groove and in which air flows. Also, in the micro mixer is arranged a secondary channel part 17-2 composed of plural channels so as to get across the liquid-fixer channel 17-1*a* and the air channel 17-1*b*. The primary and secondary channel parts 17-1 and 17-2 are integrally arranged in the micro mixer. The secondary channel part 17-2 is formed by multi-structure U-shaped partition walls. At the top surface of the channels, a lid member is fixed. Also, at a predetermined position of the lid member, a slit opening 17-3 is bored so as to correspond to the plural channels. At a position opposite to the slit opening 17-3, the coating roller (not shown) is provided. In the foam generation unit 17 thus configured, the liquid fixer and air flow in the liquid-fixer channel 17-1*a* and the air channel 17-1*b* shown in FIG. 1A, respectively. The liquid fixer and the air are introduced into the secondary channel part 17-2, and then alternately merged and mixed with each other when flowing in an air-and-liquid mixing part 18 having the slit opening 17-3. In this manner, the foam-like fixer is generated and supplied onto a coating roller (not shown) from the slit opening 17-3.

Generally, the micro mixer serving as the foam generation unit shown in FIG. 1 is used for mixing and reacting two types of liquid with each other, but less used for mixing air and liquid with each other. However, it is possible to mix air and liquid with each other to generate foams using a commercially-available micro mixer (micro mixer SSIMM-SS-Ni25 manufactured by IMM company).

In the nonthermal fixing method using the foam-like fixer, the diameter of foams is required to be smaller than at least a toner pile height (thickness of a toner layer). However, it is difficult to reliably generate foams having a substantially small diameter according to the method using the commercially-available micro mixer shown in FIG. 1. Further, in order to generate fine foams, it is effective to reduce the width of the secondary channel part 17-2 shown in FIG. 1 and narrow intervals between adjacent channels. However, the risk of clogging due to foreign matter increases as the width of the secondary channel part 17-2 reduces.

Patent Document 1: JP-A-2006-078537
Patent Document 2: JP-A-2007-219105
Patent Document 3: JP-A-2008-197188

SUMMARY OF THE INVENTION

The present invention has been made in light of the above problems and may provide a fixing device and an image forming apparatus capable of reducing the risk of clogging due to foreign matters and generating foams having a small particle diameter.

According to an aspect of the present invention, there is provided a fixing device including a liquid supply unit that supplies a liquid fixer containing a softening agent that dissolves or swells at least a part of a resin to soften the resin; an air supply unit that supplies air for foaming the liquid fixer; and a foam generation unit that mixes the liquid fixer supplied from the liquid supply unit with the air supplied from the air supply unit to generate foams. In the fixing device, the foam generation unit has an air channel in which the air supplied from the air supply unit flows, a liquid-fixer channel provided such that the liquid fixer supplied from the liquid supply unit flows from a direction opposite to a flowing direction of the air channel, and an air-and-liquid mixing part that mixes the air supplied from the air channel with the liquid fixer supplied from the liquid fixer channel in such a manner as to be opposite to each other, thereby generating a foam-like fixer.

According to another aspect of the present invention, there is provided an image forming apparatus including an image forming unit that performs an electrostatic recording process using a developing agent having resin fine particles containing a resin and a coloring agent and forms an unfixed toner image on a medium; and a fixing unit that fixes the unfixed toner image to the medium using the fixing device described above.

According to the fixing device of embodiments of the present invention, it is possible to reduce the risk of clogging due to foreign matter and generate foams having a small particle diameter.

Other objects, features and advantages of the present invention will become more apparent from the following detailed description when read in conjunction with the accompanying drawings.

DETAILED DESCRIPTION OF THE PREFERRED EMBODIMENTS

Figure 2:
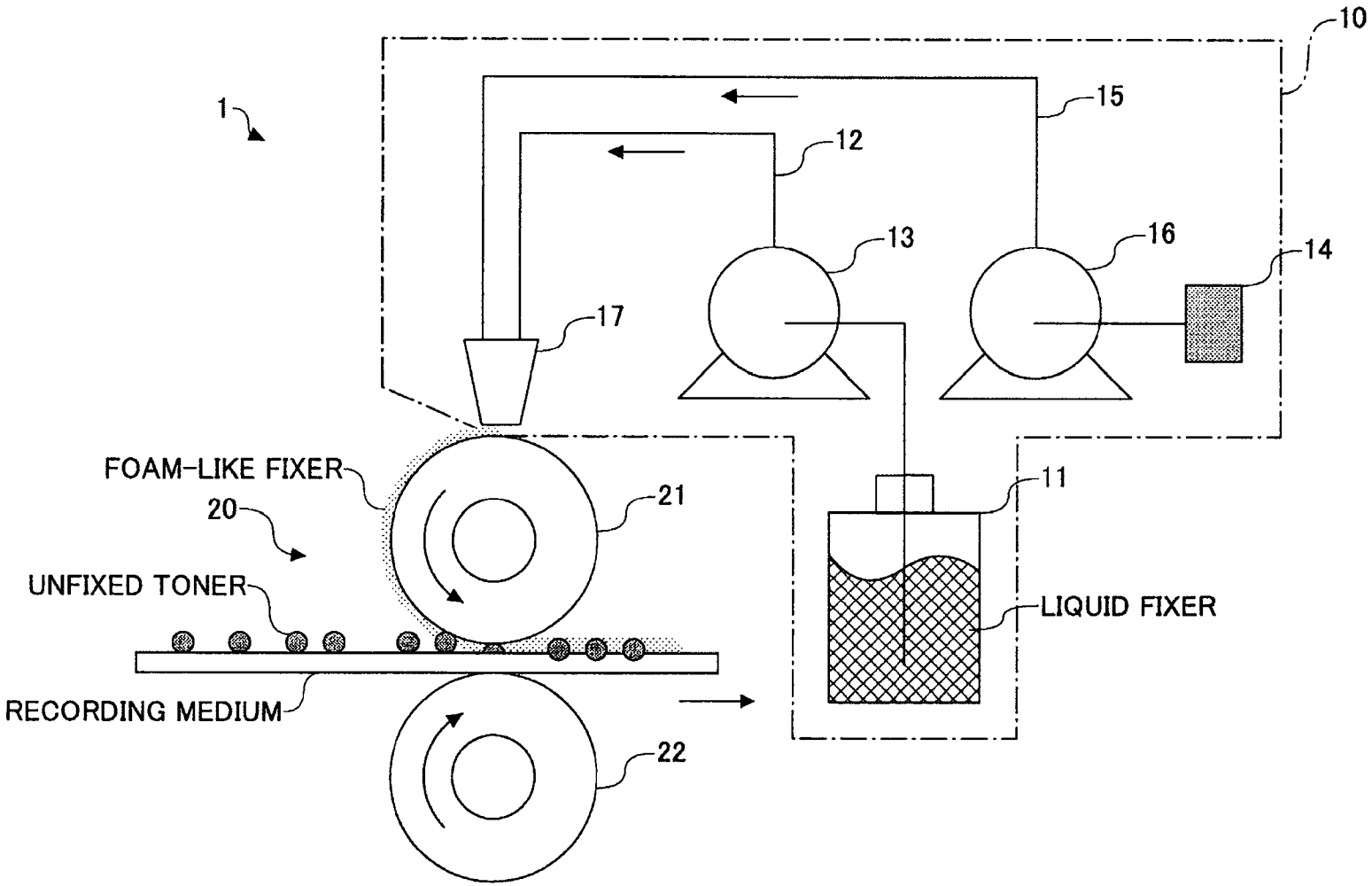
FIG. 2 is a schematic configuration diagram showing the configuration of a fixing device according to an embodiment of the present invention.

FIG. 2 is a schematic configuration diagram showing the configuration of a fixing device according to an embodiment of the present invention. The fixing device 1 according to this embodiment shown in FIG. 2 has mainly a foam-like-fixer generation unit 10 and a foam-like-fixer coating unit 20. The foam-like-fixer generation unit 10 has a liquid-fixer container 11, a liquid supply unit 13, an air supply unit 16, and a foam generation unit 17. The liquid-fixer container 11 accommodates a liquid fixer containing a softening agent that dissolves or swells at least a part of a resin to soften fine particles containing the resin. The liquid supply unit 13 is a pump or the like that supplies the liquid fixer under pressure to a foam generation unit described below via a tube 12 for supplying the liquid fixer under pressure. The air supply unit is a pump or the like that takes in air via a filter 14 and supplies the same under pressure via a tube 15 for supplying the air under pressure. The foam generation unit 17 mixes the liquid fixer with the air fed under pressure by the air supply unit 16 to generate the foam-like fixer. Further, the foam-like-fixer coating unit 20 has a coating roller 21 and a pressure roller 22. The coating roller 21 coats unfixed toner on a recording medium at the nip of the coating roller 21 and the pressure roller 22 with the foam-like fixer having a predetermined film thickness. The pressure roller 22 is provided opposite to the coating roller 21 so as to hold the recording medium being conveyed between the coating roller 21 and the pressure roller 22, and applies pressure to the recording medium in tandem with the coating roller 21.

Figure 3B:
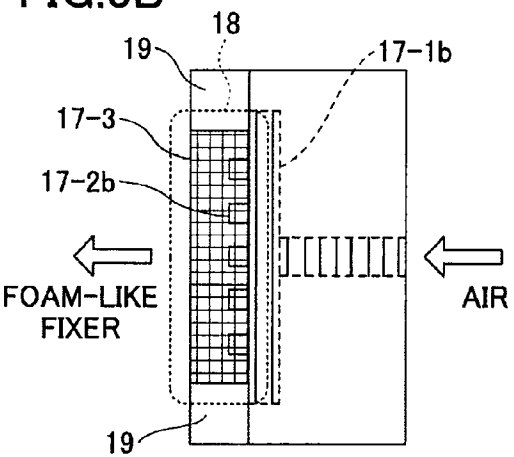
FIGS. 3A through 3C are diagrams showing the configuration of a foam generation unit according to a first embodiment of the present invention.
Figure 3A:
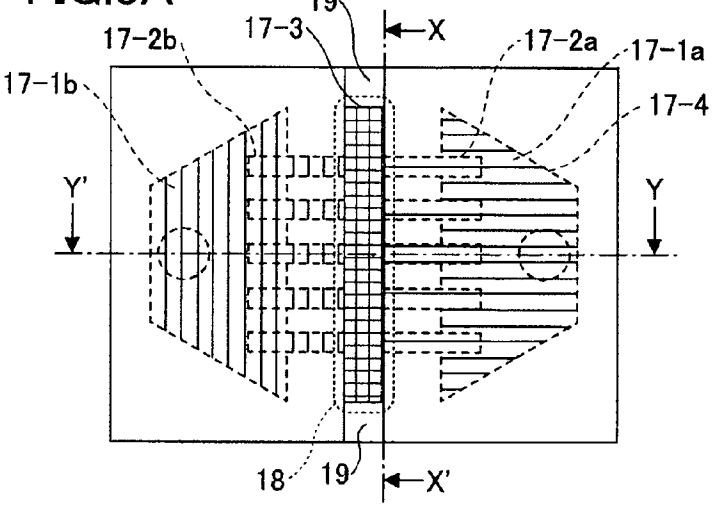
Figure 3C:
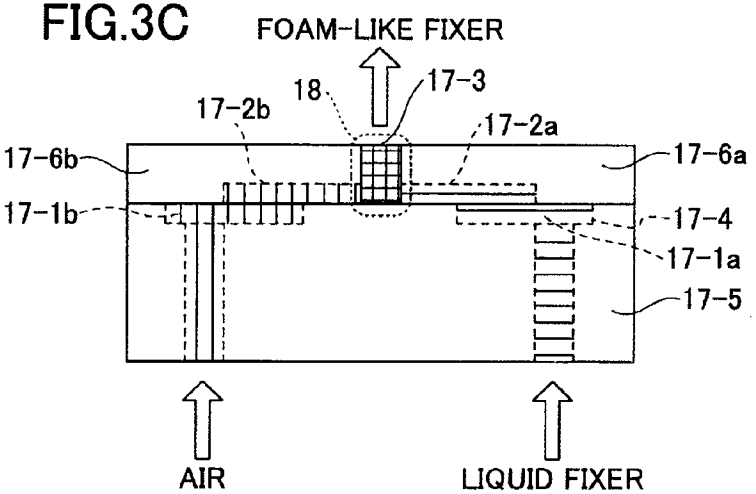

FIGS. 3A through 3C are diagrams showing the configuration of a foam generation unit according to a first embodiment of the present invention. FIG. 3A is a plan transparent view of the foam generation unit, FIG. 3B is a cross-sectional view taken along the line X-X' of FIG. 3A, and FIG. 3C is a cross-sectional view taken along the line Y-Y' of FIG. 3A. The foam generation unit 17 according to this embodiment shown in FIGS. 3A through 3C has a primary channel part 17-1, a secondary channel part 17-2, and a slit opening 17-3. The primary channel part 17-1 has a liquid-fixer channel 17-1*a* in which a liquid fixer containing a softening agent flows and an air channel 17-1*b* in which air flows from the direction opposite to the flowing direction of the liquid-fixer channel 17-1*a*. The secondary channel part 17-2 includes plural channels each being in communication with the liquid-fixer channel 17-1*a* and the air channel 17-2*a*, and is provided at an upper layer part so as to overlap with a part of the primary channel part 17-1. The slit opening 17-3 discharges the foam-like fixer generated by an air-and-liquid mixing part 18 where air and the fixer is mixed with each other to generate the foam-like fixer. The air and the fixer, which have passed through the liquid-fixer channel 17-1*a* and the air channel 17-1*b* and further have passed through the secondary channel part 17-2 overlapped with each part of the liquid-fixer channel 17-1*a* and the air channel 17-1*b* and positioned at the upper layer part, are uniformly mixed with each other in the air-and-liquid mixing part 18 so as to generate foams. The foam-like fixer thus foamed is discharged from the slit opening 17-3 serving as a slit-like exit on the air-and-liquid mixing part 18 and then coated on the roller surface of the coating roller 21 shown in FIG. 2. Then, the foam-like fixer coated on the coating roller 21 makes contact with unfixed toner on a recording medium at the nip of the coating roller 21 and the pressure roller 22 shown in FIG. 2, and then penetrates into a toner layer under the pressure of the pressure roller 22. The penetrating fixer dissolves or swells at least a part of the toner to fix the toner to the recording medium.

Figure 4B:
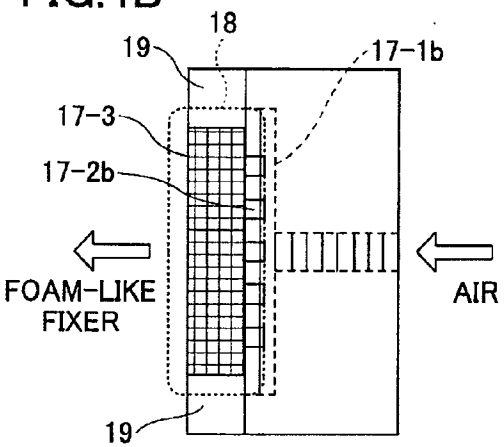
FIGS. 4A through 4C are diagrams showing the configuration of a foam generation unit according to a second embodiment of the present invention.
Figure 4A:
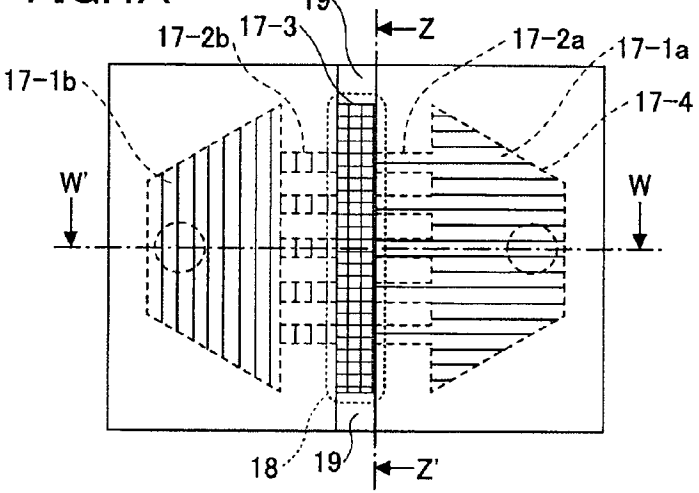
Figure 4C:
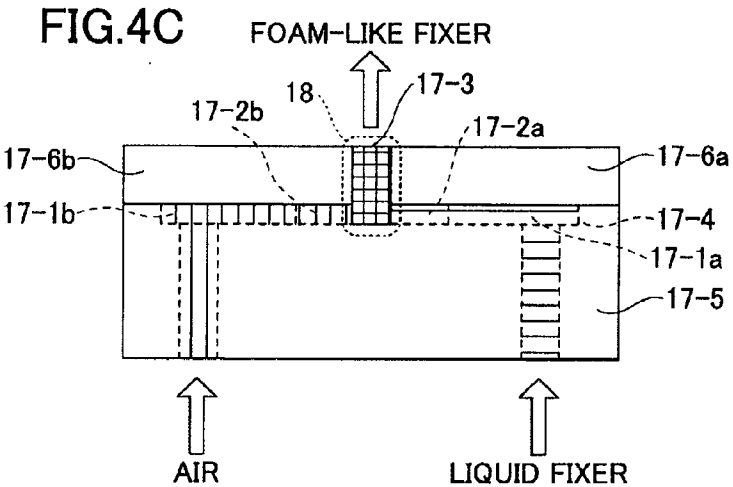

FIGS. 4A through 4C are diagrams showing the configuration of a foam generation unit according to a second embodiment of the present invention. FIG. 4A is a plan transparent view of the foam generation unit, FIG. 4B is a cross-sectional view taken along the line Z-Z' of FIG. 4A, and FIG. 4C is a cross-sectional view taken along the line W-W' of FIG. 4A. In FIGS. 4A through 4C, components the same as those of FIGS. 3A through 3C are denoted by the same reference numerals. The foam generation unit 17 according to this embodiment shown in FIGS. 4A through 4C has a primary channel part 17-1, a secondary channel part 17-2, and a slit opening 17-3. The primary channel part 17-1 has the liquid-fixer channel 17-1*a* in which a liquid fixer containing a softening agent flows and the air channel 17-1*b* in which air flows from the direction opposite to the flowing direction of the liquid-fixer channel 17-1*a*. The secondary channel part 17-2 includes plural channels each being in communication with the liquid-fixer channel 17-1*a* and the air channel 17-1*b* and provided at the same layer part. The slit opening 17-3 discharges the foam-like fixer generated by an air-and-liquid mixing part 18 where air and the fixer is mixed with each other to generate the foam-like fixer. The foam generation unit according to the second embodiment is different from the foam generation unit according to the first embodiment in that the secondary channel part 17-2 is provided at the same layer part as the liquid-fixer channel 17-1*a* and the air channel 17-1*b*. The air and the fixer, which have passed through the liquid-fixer channel 17-1*a* and the air channel 17-1*b* and further have passed through the secondary channel part 17-2 having the plural channels each being in communication with the liquid-fixer channel 17-1*a* and the air channel 17-1*b*, are uniformly mixed with each other in the air-and-liquid mixing part 18. The foam-like fixer thus foamed is discharged from the slit opening 17-3 serving as a slit-like exit on the air-and-liquid mixing part 18 and then coated on the roller surface of the coating roller 21 shown in FIG. 2. Then, the foam-like fixer coated on the coating roller 21 makes contact with unfixed toner on a recording medium at the nip of the coating roller 21 and the pressure roller 22 shown in FIG. 2, and then penetrates into a toner layer under the pressure of the pressure roller 22. The penetrating fixer dissolves or swells at least a part of the toner to fix the toner to the recording medium.

Figure 1A:
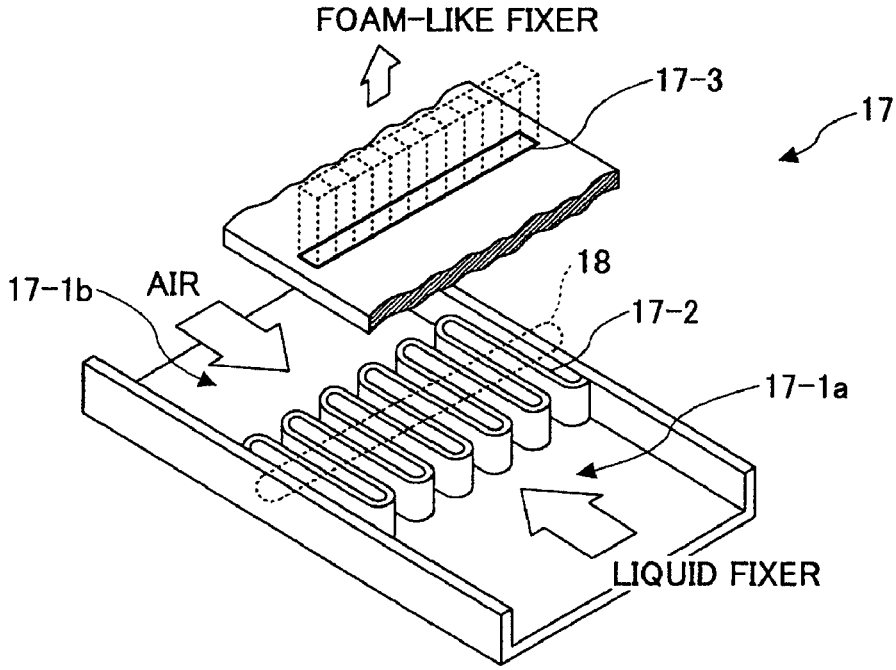
FIGS. 1A and 1B are diagrams showing an example of a foam generation unit.
Figure 1B:
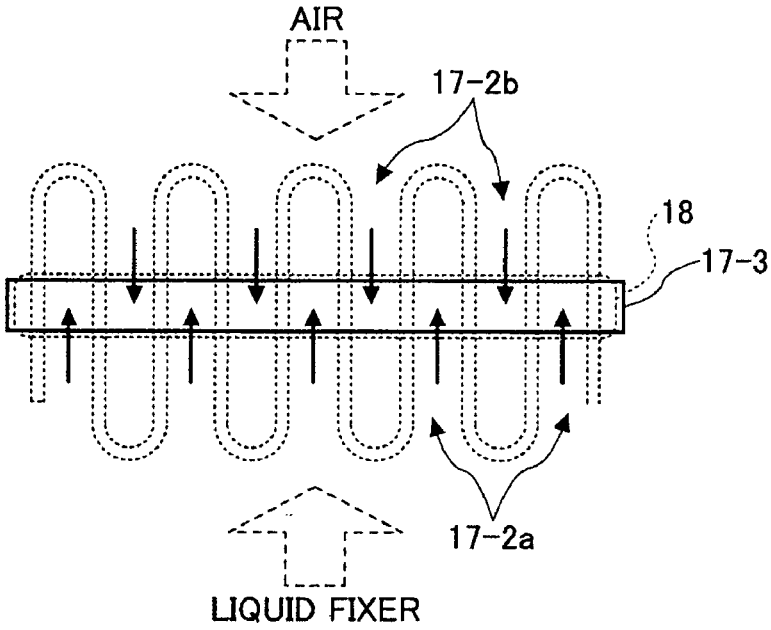

According to the first and second embodiments described above, the liquid-fixer channel 17-1*a* and the air channel 17-1*b* of the primary channel part 17-1 are configured to be directly in communication with the air-and-liquid mixing part 18 through the secondary channel part 17-2. Accordingly, if the number of the secondary channels in communication with the liquid-fixer channel 17-1*a* is the same as that of the secondary channels in communication with the air channel 17-1*b*, the width of the secondary channels of the foam generation unit according to the first and second embodiment can be more widened than the foam generation unit shown in FIGS. 1A and 1B in which the secondary channels 17-2*a* and 17-2*b* are arranged in an alternate manner. As a result, clogging due to foreign matter caused in the secondary channel part can be prevented. Further, since foams are generated immediately before being coated on the coating roller, a distance for supplying the foams under pressure can be reduced, which in turn eliminates need for installing a high-capacity pump. Moreover, foams are degraded with time after being generated. Therefore, the foams having existed for a predetermined time or more must be discharged outside a system. Accordingly, if the distance for supplying the foams under pressure is long, a large amount of foams must be discharged so as to serve as a large buffer of the foam-like fixer. However, according to the embodiments of the present invention, it is only required to discharge a small amount of the foams left in the foam generation unit having a small volume.

Figure 5A:
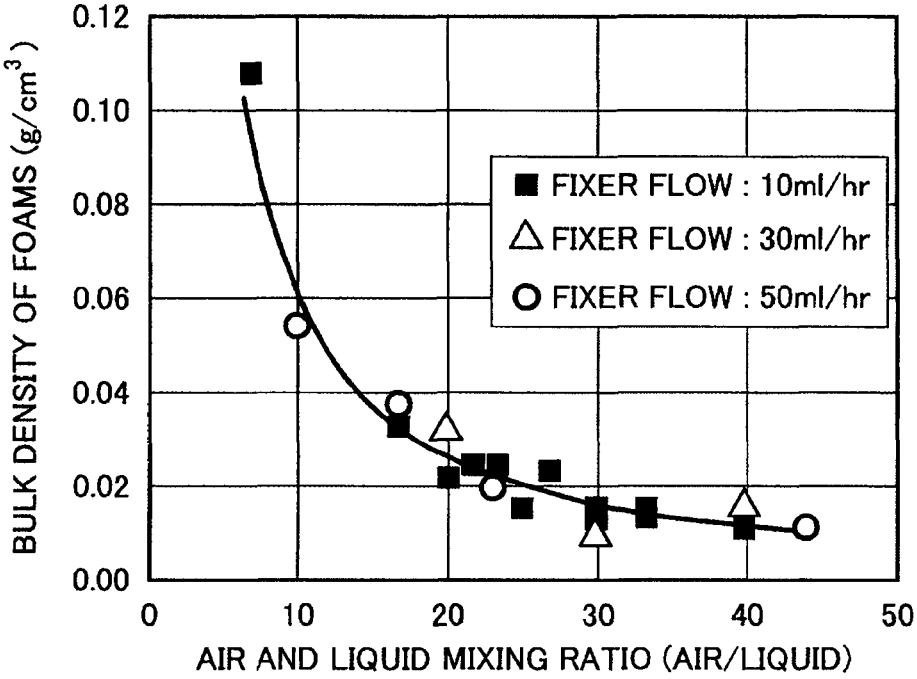
FIGS. 5A and 5B are diagrams showing an example of experimental results.
Figure 5B:
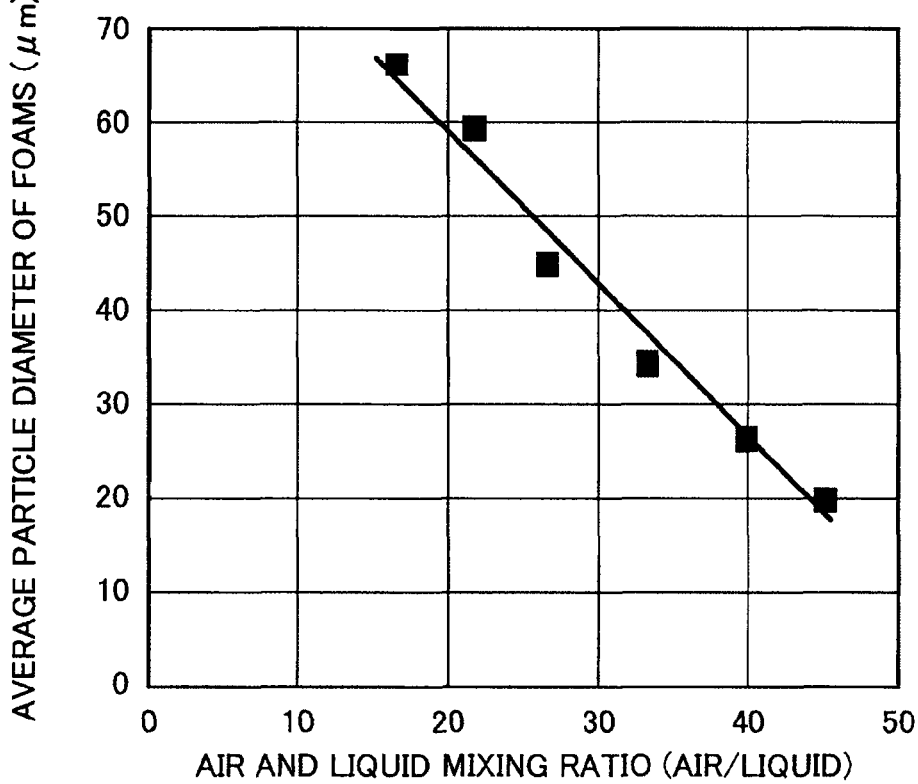

Generally, a micro mixer is often used for mixing and reacting two types of liquid with each other, but less used for mixing air and liquid with each other as in the embodiments. The foams used in the embodiments of the present invention have an average particle diameter of about 20 μm and a bulk density of 0.05 g/cm$^3$ or less, preferably 0.02 g/cm$^3$. That is, the foams having a volume extremely smaller than that of air, which are so-called dry foams, are used in the embodiments of the present invention. It is very difficult to foresee if such fine dry foams can be generated using the micro mixer based on knowledge. Therefore, an experiment was conducted using a commercially-available micro mixer (SSIMM-SS-Ni25 manufactured by IMM company). FIGS. 5A and 5B are diagrams showing an example of experimental results. FIG. 5A is a graph showing data obtained when a fixer flow is changed to any of 10 ml/hr, 30 ml/hr, and 50 ml/hr, indicating that a horizontal axis is an air-and-liquid mixing ratio and a vertical axis is a bulk density of foams. It is clear from FIG. 5A that nearly the same bulk density is obtained under the same air-and-liquid mixing ratio regardless of a difference in the fixer flow. Moreover, under appropriate control of the air-and-liquid mixing ratio, it is possible to generate dry foams having a bulk density of 0.02 cm$^3$ or less. FIG. 5B is a graph showing data obtained when an air flow is changed with a fixer flow set to 30 ml/hr at all times, indicating that a horizontal axis is an air-and-liquid mixing ratio and a vertical axis is an average particle diameter of foams. It is clear from FIG. 5B that foams having a smaller diameter can be generated with an increase of the air flow. Further, under appropriate control of the air flow, it is possible to generate fine foams having an average particle diameter of 20 μm or less.

Figure 6:
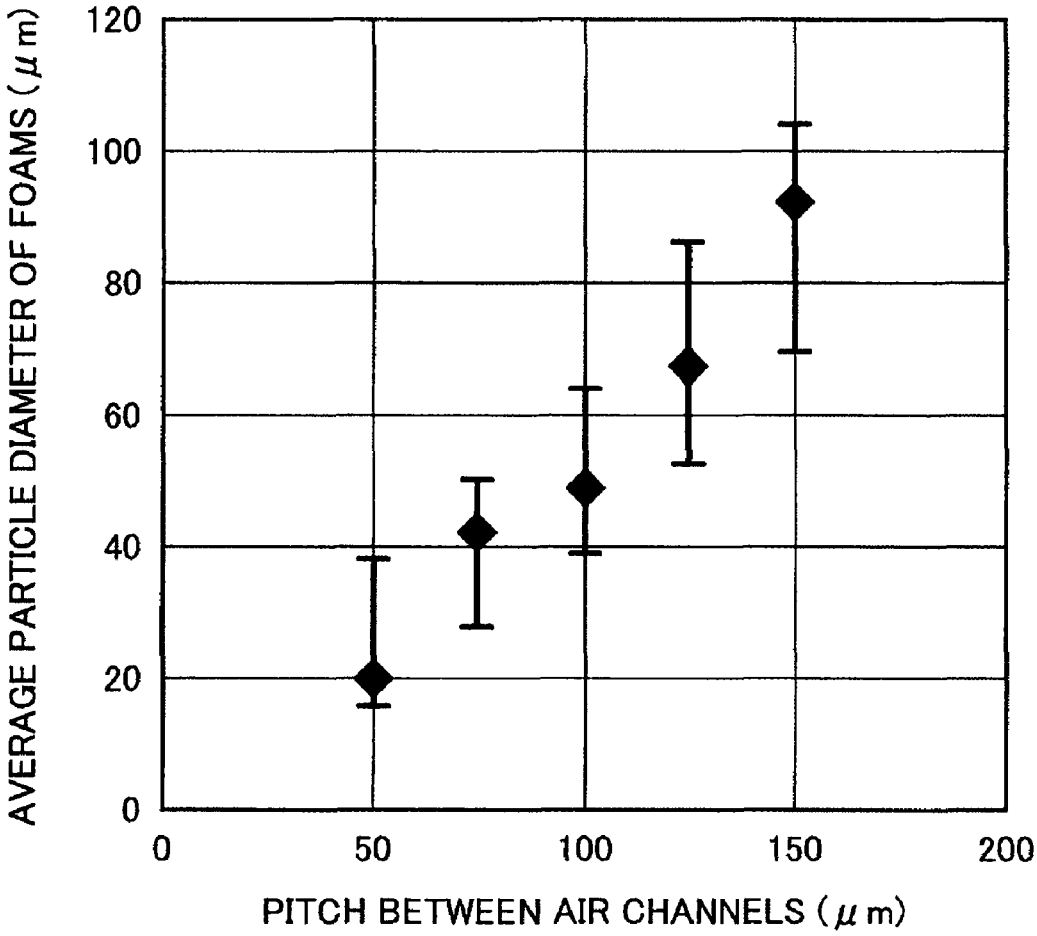
FIG. 6 is a diagram showing a relationship between an air channel pitch and an average particle diameter of foams in the foam generation unit of the fixing device according to the embodiments of the present invention.

FIG. 6 is a diagram showing a relationship between an air channel pitch and an average particle diameter of generated foams. It is clear from FIG. 6 that the average particle diameter of generated foams becomes smaller as the air channel pitch is narrowed. In the example shown in FIGS. 1A and 1B, the secondary channels 17-2*a* in which the fixer flows and the secondary channels 17-2*b* in which air flows are arranged in an alternate manner unlike the foam generation unit of the fixing device according to the first and second embodiments of the present invention shown in FIGS. 3A through 3C and FIGS. 4A through 4C, respectively. In other words, if the width of the secondary channels 17-2*a* is the same as that of the secondary channels 17-2*b*, it is possible to narrow a pitch between the secondary channels 17-2*b* of the fixing device according to the embodiments of the present invention. It is clear from the experimental results shown in FIG. 6 that the foam generation unit of the fixing device according to the embodiments of the present invention is effective for generating foams having a small particle diameter.

In the case of the foam generation unit 17 shown in FIG. 1, the secondary channels 17-2*a* in which the fixer flows extend to the opposite side over the air-and-liquid mixing part 18. Accordingly, the terminal ends of the secondary channels 17-2*a* are positioned on the opposite side over the air-and-liquid mixing part 18. Similarly, the secondary channels 17-2*b* in which the air flows extend to the opposite side over the air-and-liquid mixing part 18, and the terminal ends of the secondary channels 17-2*a* are also positioned on the opposite side over the air-and-liquid mixing part 18. In other words, in the case of the foam generation unit 17 shown in FIG. 1, the secondary channels 17-2*a* in which the liquid fixer flows are adjacent to the secondary channels 17-2*b* in which air flows in an area other than the slit opening 17-3. If the foam generation unit 17 is constructed by a member having high rigidity such as metal, no problem arises. However, if the foam generation unit 17 is constructed by a member having low rigidity such as a resin, there arises a problem in a sealing property between the adjacent channels. In other words, in this case, the air and the liquid are mixed with each other in areas other than the air-and-liquid mixing part 18, which results in unstable foam generation. Conversely, in the foam generation unit 17 of the fixing device according to the first and second embodiments of the present invention, the liquid fixer channel 17-1*a* of the primary channel part 17-1 in which the liquid fixer flows and the air channel 17-1*b* in which the air flows are arranged so as not to be adjacent to each other. Accordingly, even if a primary channel constituent member 17-5 and secondary channel constituent members 17-6*a* and 17-6*b* are constructed by a member having low rigidity such as a resin, a problem due to lack of a sealing property hardly arises.

Figure 7A:
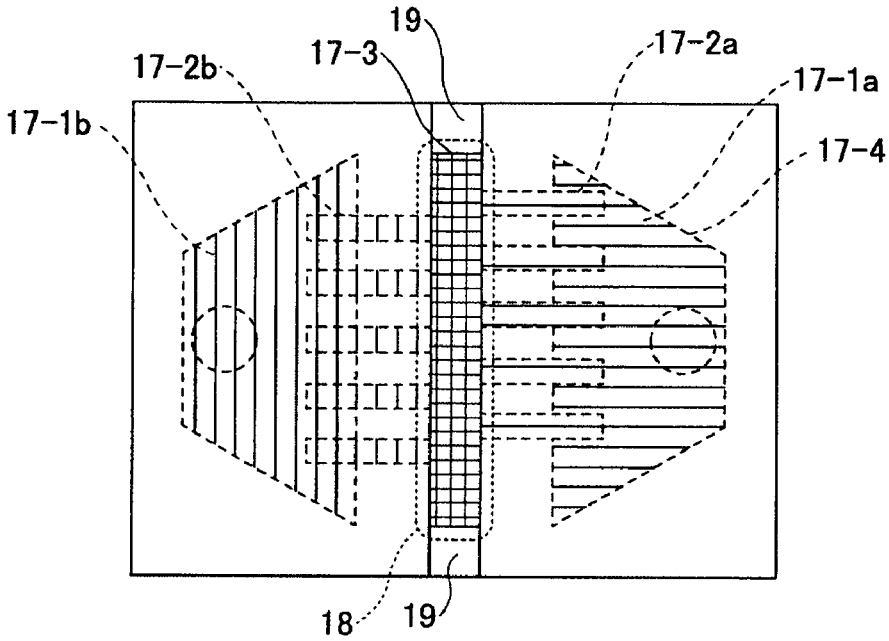
FIGS. 7A and 7B are plan transparent diagrams showing the configuration of a foam generation unit according to a third embodiment of the present invention.
Figure 7B:
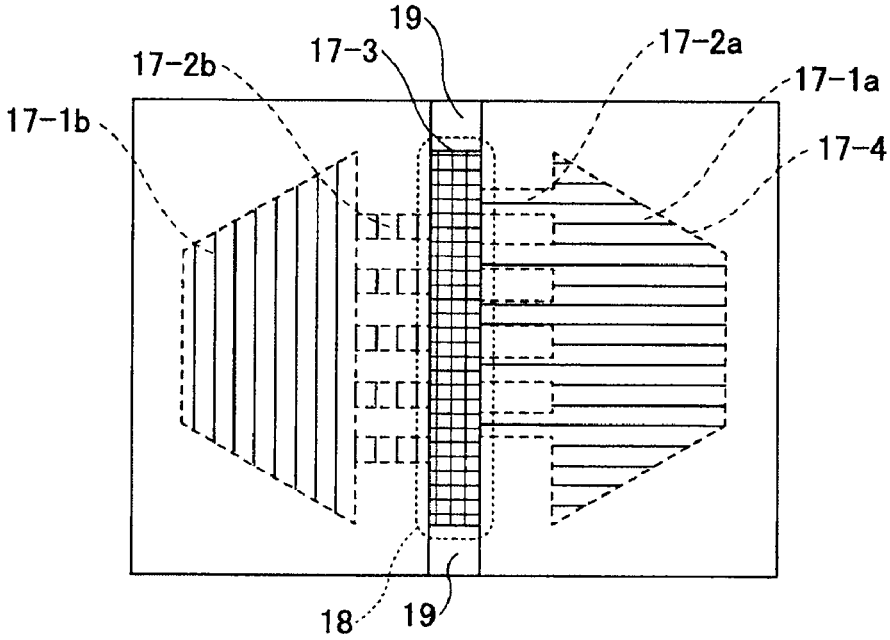

FIGS. 7A and 7B are plan transparent diagrams showing the configuration of a foam generation unit according to a third embodiment of the present invention. As is clear from FIGS. 7A and 7B, the foam generation unit according to the third embodiment is different from the foam generation units according to the first and second embodiments shown in FIGS. 3A through 3C and FIGS. 4A through 4C, respectively, in that the openings of the liquid-fixer channel 17-1*a* are shifted from the openings of the air channel 17-1*b* by half a pitch. Accordingly, when a current stream is generated in the air-and-liquid mixing part 18 under this configuration, air and liquid can be more efficiently mixed with each other so as to turn a fixer having high viscosity into foams. As a result, a foaming property can be improved.

Figure 8:
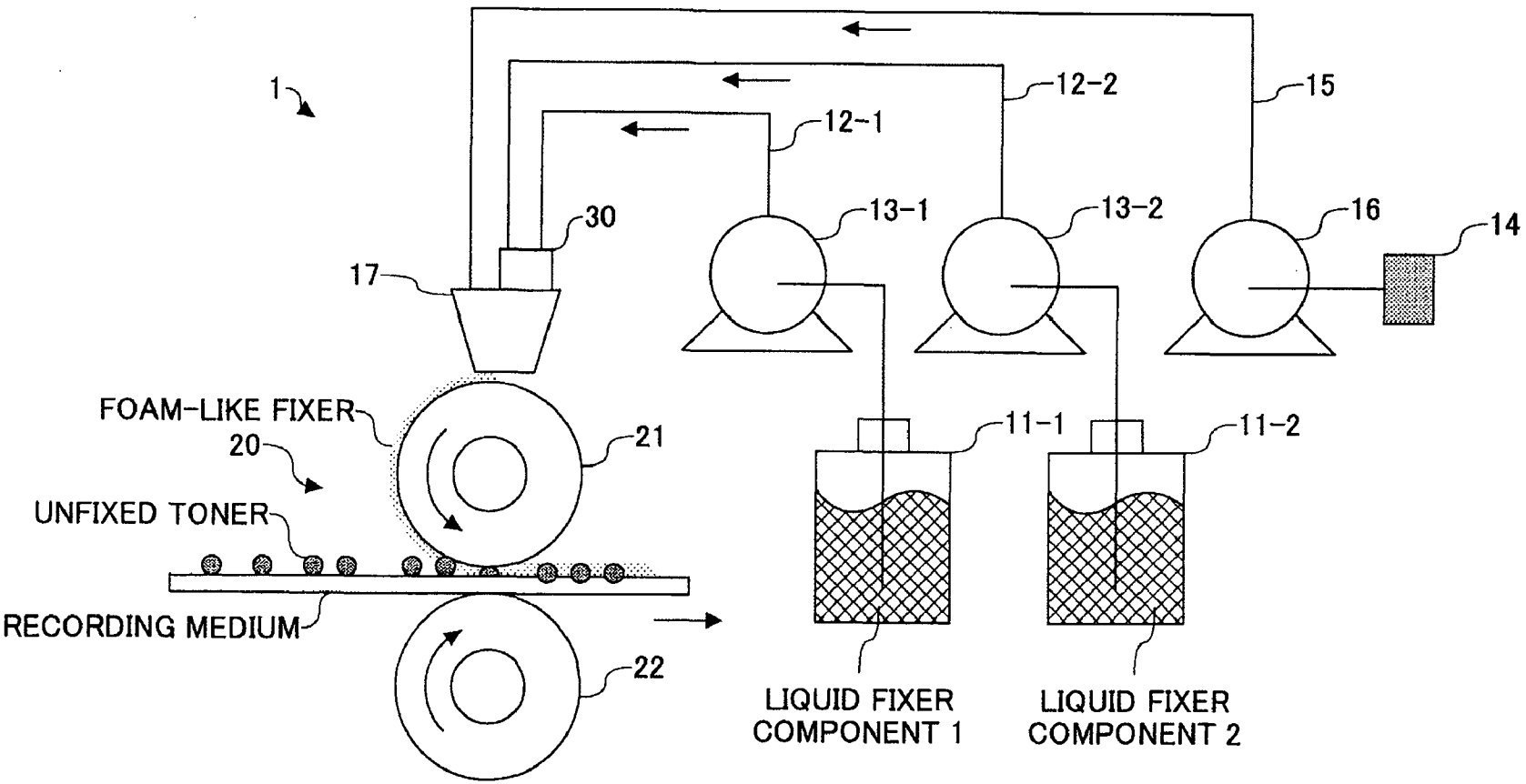
FIG. 8 is a schematic configuration diagram showing another configuration of the fixing device according to the embodiment of the present invention.

Note that a description is made of a configuration in which a fixer is supplied to a liquid mixing unit from plural liquid supply units that supply plural constituent components of the fixer and then the mixed fixer is supplied to the foam generation unit to generate foams. In the fixer, components such as a softening agent, a foaming agent, and a foam increasing agent are mixed with each other. However, if all of these components are mixed with each other, the properties of the fixer are changed with time due, for example, to hydrolytic cleavage. As a result, a desired fixing property may not be obtained. In order to address this problem, the components are mixed with each other in the manner shown in FIG. 8. Specifically, the components causing time degradation are separately stored in liquid-fixer containers 11-1 and 11-2, supplied under pressure to a liquid mixing unit 30 provided in the foam generation unit 17 according to the first and second embodiments, and are mixed with each other immediately before being used. After that, an air supply unit 16 supplies air for generating foams to the liquid fixer mixed by the liquid mixing unit 30, and the liquid fixer is uniformly mixed with each other in a foam generation unit 17 to generate foams. As the liquid mixing unit, a variety of micro mixers can be used. The unit shown in FIGS. 1A and 1B can also be used as it is.

Figure 9A:
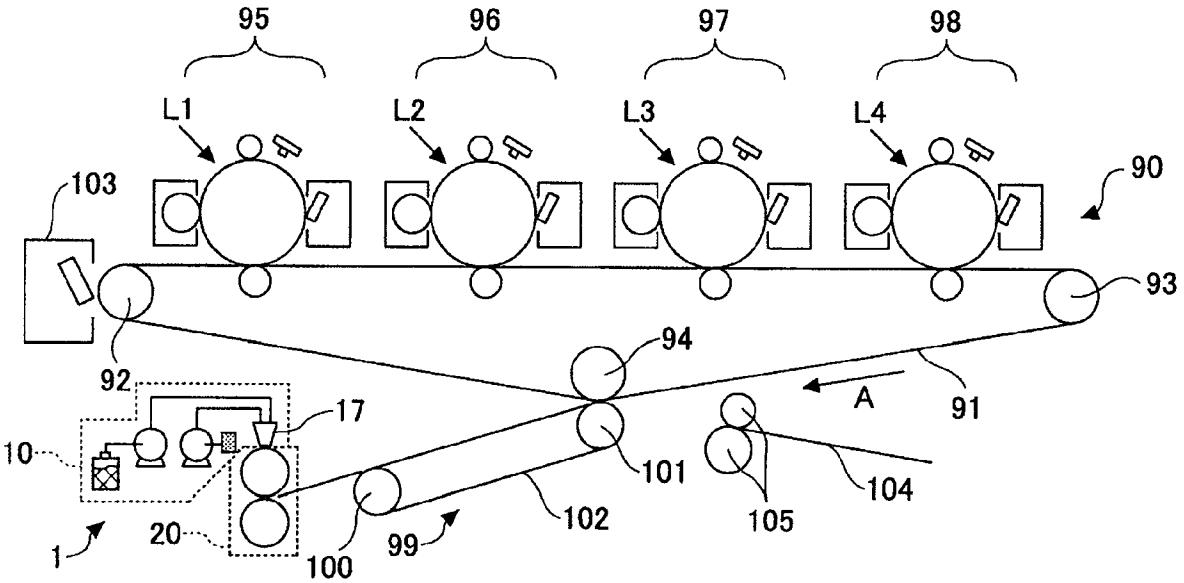
FIGS. 9A and 9B are schematic diagrams showing the configuration of an image forming apparatus according to an embodiment of another invention.
Figure 9B:
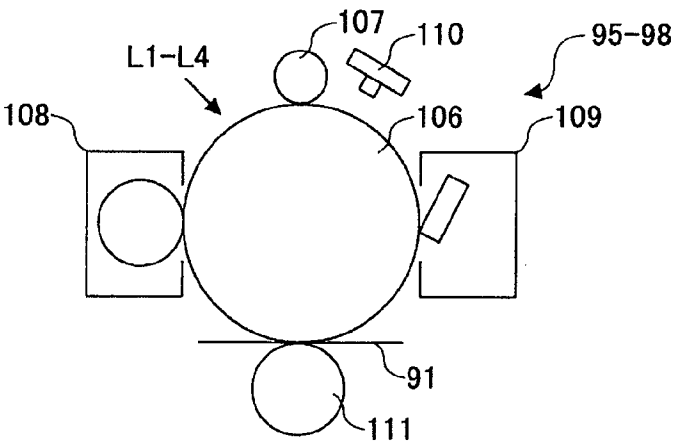

FIGS. 9A and 9B are schematic diagrams showing the configuration of an image forming apparatus according to an embodiment of another invention. The image forming apparatus shown in FIGS. 9A and 9B may be a copier or a printer. FIG. 9A is the schematic diagram entirely showing a tandem-type color electrophotographic image forming apparatus. FIG. 9B is the diagram showing the configuration of one image forming unit of the image forming apparatus shown in FIG. 9A. The image forming apparatus 90 shown in FIGS. 9A and 9B has an intermediate transfer belt 91 serving as a toner-image carrier. The intermediate transfer belt 91 is bridged over three support rollers 92 through 94 and rotates in the direction as indicated by arrow A in FIG. 9A. With respect to the intermediate transfer belt 91, the image forming units 95 through 98 for black, yellow, magenta, and cyan are arranged. Above the image forming units 95 through 98, exposure units (not shown) are arranged. For example, if the image forming apparatus is a copier, image information of a document is scanned by a scanner, and then exposure light beams L1 through L4 for writing electrostatic latent images on photosensitive drums are applied by the exposure units so as to correspond to the image information. At a position opposite to the support roller 94 via the intermediate transfer belt 91, a secondary transfer unit 99 is arranged. The secondary transfer unit 99 is composed of two support rollers 100 and 101 and a secondary transfer belt 102 bridged over the two support rollers 100 and 101. Note that as the secondary transfer unit 99, a transfer roller may be used instead of the transfer belt. Further, at a position opposite to the support roller 92 via the intermediate transfer belt 91, a belt cleaning unit 103 is arranged. The belt cleaning unit 103 is arranged to eliminate toner left on the intermediate transfer belt 91.

A recording sheet 104 serving as a recording medium is guided to a secondary transfer part by a pair of sheet feeding rollers 105. When a toner image is transferred onto the recording sheet 104, a secondary transfer belt 102 is pressed against the intermediate transfer belt 91. The recording sheet 104 onto which the toner image has been transferred is conveyed by the secondary transfer belt 102, and then the unfixed toner image transferred onto the recording sheet 104 is fixed by the fixing device 1 according to the embodiments of the present invention composed of the foam-like-fixer generation unit 10 having at least the foam generation unit 17 and the foam-like-fixer coating unit 20. In other words, the foam-like-fixer coating unit 20 coats the unfixed toner image, which has been transferred onto the recording sheet 104, with the foam-like fixer generated by the foam-like-fixer generation unit 10 having the foam generation unit of the fixing device 1 based on image information from the exposure units (not shown), for example, a color image or a black solid image. Then, the unfixed toner image is fixed to the recording sheet 104 by an agent (softening agent), which is contained in the foam-like fixer and dissolves or swells at least a part of a resin contained in the toner.

Next, the image forming units are described. As shown in FIG. 9B, each of the image forming units 95 through 98 has a charging unit 107, a development unit 108, a cleaning unit 109, and an electricity eliminating unit 110 at its periphery of a photosensitive drum 106. In addition, a primary transfer unit 111 is provided at a position opposite to the photosensitive drum 106 via the intermediate transfer belt 91. Moreover, the charging unit 107 is a contact-charging-type charging unit that uses a charging roller. The charging unit 107 brings the charging roller into contact with the photosensitive drum 106 to apply voltage to the photosensitive drum 106, thereby uniformly charging the front surface of the photosensitive drum 106. As the charging unit 107, a non-contact-charging-type charging unit, which uses a non-contact scorotron or the like, can be used. Further, the development unit 108 attaches toner of developing powder to an electrostatic latent image on the photosensitive drum 106 to make the electrostatic latent image visualized. Here, the toner corresponding to each color is made of a resin material colored in the corresponding color, and the resin material is dissolved or swelled by the fixer according to the embodiments of the present invention. Note that the development unit 108 has a stirring part and a development part (not shown). The developing powder not used for development is returned to the stirring part and reused. The concentration of the toner in the stirring part is detected by a toner concentration sensor and controlled so as to be constant. Moreover, the primary transfer unit 111 transfers the toner visualized on the photosensitive drum 106 onto the intermediate transfer belt 91. Here, a transfer roller is used as the primary transfer unit 111 and pressed against the photosensitive drum 106 via the intermediate transfer belt 91. As the primary transfer unit 111, a conductive brush, a non-contact corona charger, or the like may be used. Further, the cleaning unit 109 eliminates unnecessary toner on the photosensitive drum 106. As the cleaning unit 109, a blade whose tip end is pressed against the photosensitive drum 106 may be used. Here, the toner collected by the cleaning unit 109 is fed to the development unit 108 by a collecting screw and a toner recycling unit (not shown), and then reused. Moreover, the electricity eliminating unit 110 is constructed by a lamp and irradiates the photosensitive drum 106 with light so as to initialize potential at the front surface of the photosensitive drum 106.

As described above, it is possible to provide the image forming apparatus capable of preventing clogging due to foreign matter and reliably achieving image formation with the provision of the fixing device according to the embodiments of the present invention. In addition, it is possible to provide the nonthermal-fixing-type image forming apparatus capable of coating a recording medium with the foam-like fixer without consuming a large energy, and capable of minimizing an amount of the foam-like fixer to be discharged outside the system because fixing is not performed for a certain period of time to change the properties of the foam-like fixer.

According to the embodiments of the present invention described above, the foam generation unit of the fixing device includes the air channel in which the air supplied from the air supply unit flows, the liquid-fixer channel provided such that the liquid fixer supplied from the liquid supply unit flows from the direction opposite to the flowing direction of the air channel, and the air-and-liquid mixing part that mixes the air supplied from the air channel with the liquid fixer supplied from the liquid fixer channel in such a manner as to be opposite to each other, thereby generating the foam-like fixer. Accordingly, it is possible to reduce the risk of clogging due to foreign matter and generate foams having a small particle diameter. Further, the air channel and the liquid-fixer channel are in communication with the air-and-liquid mixing part via the openings formed in the terminal ends of the air channel and the liquid-fixer channel.

Accordingly, it is possible to prevent the leakage of the air and the liquid between the air channel and the liquid-fixer channel and efficiently mix the air and the liquid with each other only in the air-and-liquid mixing part. Further, the opening of the air channel formed in the air-and-liquid mixing part faces the opening of the liquid-fixer channel formed in the air-and-liquid mixing part. Accordingly, even if the air channel and the liquid-fixer channel are constructed by a member having low rigidity, a problem due to lack of a sealing property hardly arises. Further, the opening of the air channel formed in the air-and-liquid mixing part does not face the opening of the liquid-fixer channel formed in the air-and-liquid mixing part. Accordingly, it is possible to turn the fixer having high viscosity into foams more effectively. Further, an image forming apparatus includes the image forming unit that performs an electrostatic recording process using a developing agent having resin fine particles containing a resin and a coloring agent and forms an unfixed toner image on a medium; and a fixing unit that fixes the unfixed toner image to the medium using the fixing device. Accordingly, it is possible to provide the environmental-friendly image forming apparatus that reduces a loss of the fixer and does not require a large fixing energy.

The present invention is not limited to the specifically disclosed embodiments, and variations and modifications may be made without departing from the scope of the present invention.

The present application is based on Japanese Priority Application Nos. 2009-114659 filed on May 11, 2009, and 2010-009689 filed on Jan. 20, 2010, the entire contents of which are hereby incorporated herein by reference.

What is claimed is:

1. A fixing device comprising:

a liquid supply unit that supplies a liquid fixer containing a softening agent that dissolves or swells at least a part of a resin to soften the resin;

an air supply unit that supplies air for foaming the liquid fixer; and a foam generation unit that mixes the liquid fixer supplied from the liquid supply unit with the air supplied from the air supply unit to generate foams; wherein the foam generation unit includes an air channel in which the air supplied from the air supply unit flows, a liquid-fixer channel provided such that the liquid fixer supplied from the liquid supply unit flows from a direction opposite to a flowing direction of the air channel, and an air-and-liquid mixing part that mixes the air supplied from the air channel with the liquid fixer supplied from the liquid fixer channel in such a manner as to be opposite to each other, thereby generating a foam-like fixer.

2. The fixing device according to claim 1, wherein the air channel and the liquid-fixer channel are in communication with the air-and-liquid mixing part via openings formed in terminal ends of the air channel and the liquid-fixer channel.

3. The fixing device according to claim 1, wherein an opening of the air channel formed in the air-and-liquid mixing part faces an opening of the liquid-fixer channel formed in the air-and-liquid mixing part.

4. The fixing device according to claim 1, wherein an opening of the air channel formed in the air-and-liquid mixing part does not face an opening of the liquid-fixer channel formed in the air-and-liquid mixing part.

5. An image forming apparatus comprising:

an image forming unit that performs an electrostatic recording process using a developing agent having resin fine particles containing a resin and a coloring agent and forms an unfixed toner image on a medium; and a fixing unit that fixes the unfixed toner image to the medium using the fixing device according to claim 1.

* * * * *